United States Patent [19]

Wakita et al.

[11] Patent Number: 4,460,351

[45] Date of Patent: Jul. 17, 1984

[54] ROTOR FOR A CENTRIFUGE

[75] Inventors: Hiizu Wakita, Tokyo; Tadahiro Uchida, Sayama, both of Japan

[73] Assignee: Kabushiki Kaisha Kubota Seisakusho, Tokyo, Japan

[21] Appl. No.: 391,700

[22] Filed: Jun. 24, 1982

[30] Foreign Application Priority Data

Jul. 3, 1981 [JP] Japan ..... 56-104860

[51] Int. Cl.[3] ..... B04B 5/02

[52] U.S. Cl. ..... 494/16

[58] Field of Search ..... 422/72, 101, 104; 494/16, 17, 18, 20, 21

[56] References Cited

U.S. PATENT DOCUMENTS 3,168,473 2/1965 Goda et al. ..... 494/16 X
3,600,900 8/1971 Buddecke ..... 494/20 X
3,750,941 8/1973 Drucker ..... 494/16 X
4,221,325 9/1980 Kubota ..... 494/16 X

*Primary Examiner*—Robert W. Jenkins
*Assistant Examiner*—Arthur D. Dahlberg
*Attorney, Agent, or Firm*—Charles E. Pfund

[57] ABSTRACT

A rotor for a centrifuge comprises a rotatable shaft, a disc-shaped bottom plate fixed to the rotatable shaft, and a holder plate mounted on the bottom plate for holding sedimentation tubes. The holder plate is bodily constructed of a thin plate and has a bent portion positioned between a center and outer edge thereof and projecting upwardly. The bent portion includes a surface directed toward the center of the holder plate and having a plurality of holes for insertion therethrough of the sedimentation tubes. The bottom plate has a plurality of holes aligned with the holes in the holder plate for receiving the sedimentation tubes therein.

6 Claims, 4 Drawing Figures

ROTOR FOR A CENTRIFUGE

BACKGROUND OF THE INVENTION

The present invention relates to a rotor for use in a centrifuge, and more particularly to a rotor for a centrifuge for centrifuging and separating materials contained in sedimentation tubes in the form of test tubes.

There have heretofore been proposed a variety of centrifuges. As disclosed in Japanese Utility Model Publications 38-16982 and 46-27172, known centrifuges have rotors which are cut from a thick mass of aluminum alloy by a lathe or milling machine so that they are lightweight and can withstand large centrifugal forces generated on rotation at high speeds. Thus, the amount of material needed for rotors is increased with a resultant increase in the cost of material. The cost of manufacturing such rotors is also high since a prolonged period of time is required for their machining.

Centrifuges used solely for handling sedimentation tubes are poor in availability. To cope with this, there has recently been proposed a centrifuge which can be used for both blood separation and hematocrit determinations. The prior centrifuge rotors have the following problems for that matter: Centrifuges used in hematocrit determinations are required to produce a predetermined centrifugal force and operate for a predetermined continuous time according to the practice of blood test. In order to gain a sufficient centrifugal effect on blood samples within a predetermined period of time, it is necessary that the period of time required for the rotor to reach a predetermined speed of rotation, that is, the acceleration time, be shortened since no sufficient centrifugal effect occurs during such an acceleration time. Shortening the acceleration time requires that the rotor be designed to have a smaller moment of inertia. The known rotors employed for blood separation and hematocrit determinations have however been of a mechanical strength and thickness large enough to support sedimentation tubes which swing up outwardly about their pivots under centrifugal force. The rotors therefore have a large moment of inertia. To drive such rotors so as to accelerate them up to a required speed of rotation within a short period of time, such motors have to be employed which are capable of producing large driving forces and hence which are expensive.

When the prior rotor is to be used for supporting sedimentation tubes, a wind shield plate below the rotor is turned slightly until holes in the wind shield plate become aligned with tube holes in the rotor, containers are inserted obliquely into the holes in the plate and rotor, and then the sedimentation tubes with test samples contained therein are placed into the containers. The above preparatory operation needs to be effected each time the operator uses the centrifuge. Where the tube containers are inserted into the tube holes in the rotor without the procedure for getting them into alignment with the holes in the wind shield plate, the latter is liable to be damaged during operation of the centrifuge. When the rotor is to be used in hematocrit determinations subsequent to centrifugation of sedimentation tubes, the wind shield plate needs to be angularly moved for closing the tube holes in the rotor. Hematocrit determination is normally carried out at about 12,000 rpm and 15,000 G. When the tube holes are left open, they will cause air swirls which create increased resistance by air to the rotation of the rotor. The rotor therefore cannot reach a desired high speed of rotation and generates noise at a high level. The rotor is also unsafe as it allows the operator to act by mistake.

The conventional rotor that can be used for blood separation and hematocrit determinations includes a flat rotor body of aluminum alloy having grooves in which capillary tubes are retained in close contact. Heat generated due to friction with air on the surface of the rotor while the latter is rotating at a high speed is rapidly conducted to the center of the rotor, where the heat brings about a temperature rise for the capillary tubes. The blood samples in the capillary tubes are adversely affected by such a temperature change in that the condition of precipitation of the blood varies and the blood tends to undergo hemolysis.

SUMMARY OF THE INVENTION

It is an object of the present invention to provide a rotor for centrifuges which is lightweight and has a mechanical strength large enough to withstand increased centrifugal forces generated on rotation at high speeds.

Another object of the present invention is to provide a rotor for centrifuges which is constructed of a relatively small number of parts, can easily be fabricated, and is relatively inexpensive to construct.

Still another object of the present invention is to provide a rotor for centrifuges which can be used for holding both sedimentation tubes and capillary tubes.

Still another object of the present invention is to provide a rotor for centrifuges which can produce, in a short interval of time without relying on a large-capacity motor, a centrifugal force needed for hematocrit determinations when the rotor is used to support capillary tubes.

A still further object of the present invention is to provide a rotor for centrifuges which can be handled more easily than conventional rotors.

A still further object of the present invention is to provide a rotor for centrifuges which has improved heat radiation characteristics.

The above objects of the present invention can be achieved by a rotor for a centrifuge, comprising a rotatable shaft, a disc-shaped bottom plate fixed to the rotatable shaft, and a holder plate mounted on the bottom plate for holding sedimentation tubes, the holder plate being bodily constructed of a thin plate and having a bent portion positioned between a center and outer edge thereof and projecting upwardly, the bent portion including a surface directed toward the center of the holder plate and having a plurality of holes for insertion therethrough of the sedimentation tubes, and the bottom plate having a plurality of holes aligned with the holes in the holder plate for receiving the sedimentation tubes therein.

The above and other objects, features and advantages of the present invention will become more apparent from the following description when taken in conjunction with the accompanying drawings in which preferred embodiments of the invention are shown by way of illustrative example.

DESCRIPTION OF THE PREFERRED EMBODIMENTS

Figure 1:
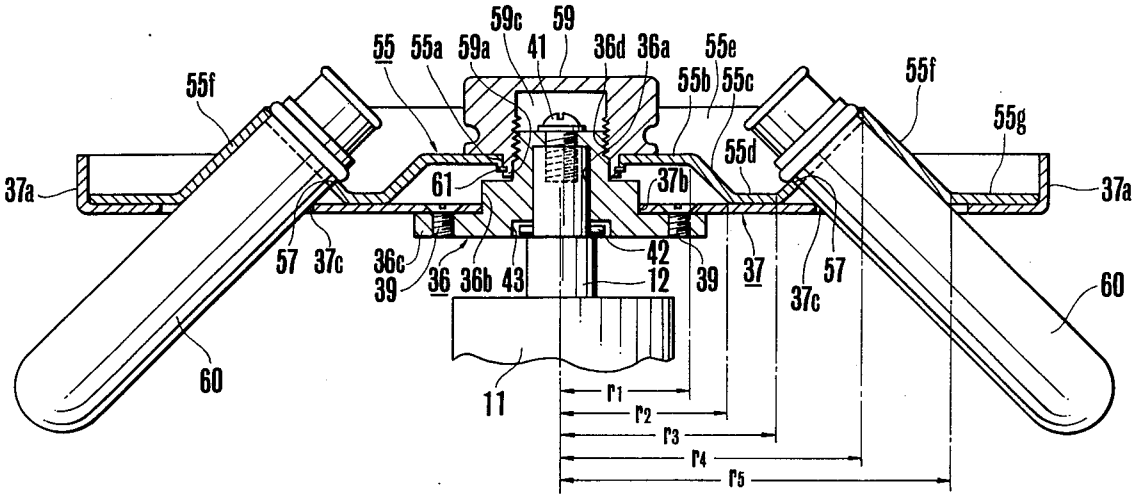
FIG. 1 is a cross-sectional view of a rotor for a centrifuge according to an embodiment of the present invention.
Figure 2:
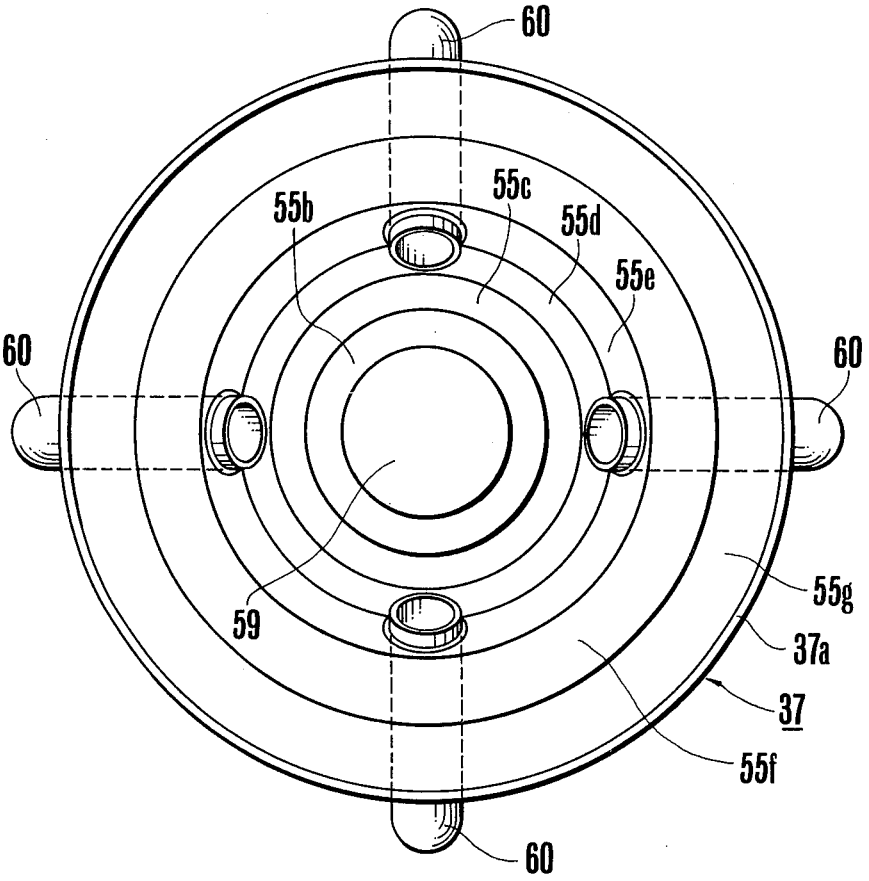
FIG. 2 is a plan view of the rotor shown in FIG. 1.

FIGS. 1 and 2 illustrate a rotor for a centrifuge according to an embodiment of the invention, the rotor being used for holding sedimentation tubes.

As shown in FIG. 1, the rotor has an attachment 36 having a central hole 36*a* receiving therein an upper end of a motor shaft 12 which is coupled directly or indirectly to a motor 11. The upper end of the motor shaft 12 inserted in the hole 36*a* is fastened by a screw 41 to an upper end of the attachment 36. The motor shaft 12 has keys 42 fitted in key slots 43 in a lower surface of the attachment 36 for corotation between the motor shaft 12 and the attachment 36. The attachment 36 includes two cylindrical steps that are concentric with each other, and a central shaft portion 36*b* interposed axially between the two cylindrical steps. The central shaft portion 36*b* is fitted in a central hole 37*b* of a bottom plate 37 having a circumferential vertical wall or flange 37*a*. The bottom plate 37 is fastened to the attachment 36 by a plurality of screws 39 threadedly extending into a lowermost one 36*c* of the steps of the attachment 36. The attachment 36 has external threads 36*d* around its upper sidewall.

The attachment 36 and the bottom plate 37 jointly constitute a rotor base on which is installed a holder plate 55 for supporting sedimentation tubes. The holder plate 55 is constructed of a sheet of metal such as aluminum, which is 2 mm thick and pressed to a cross-sectional shape as shown in FIG. 1. The holder plate 55 has a central attachment hole 55*a* which is of a diameter slightly larger than the outside diameter of the upper sidewall of the attachment 36. The holder plate 55 includes an inner flat surface 55*b* extending around the central hole 55*a* and having an outside diameter of r1, a slanted surface 55*c* extending radially outwardly and inclined downwardly from the inner flat surface 55*b*, the slanted surface 55*c* being of an outside diameter of r2, a flat surface 55*d* extending radially outwardly from the slanted surface 55*c* in contact with the bottom plate 55 and having an outside diameter r3, and a slanted surface 55*e* extending radially outwardly and inclined upwardly from the flat surface 55*d*. The slanted surface 55*e* has an outside diameter of r4. Another slanted surface 55*f* extends radially outwardly and inclined downwardly from the slanted surface 55*e*. The slanted surface 55*f* extends substantially at a right angle to the slanted surface 55*e* and has an outside diameter of r5. The slanted surface 55*f* is radially joined to a flat surface 55*g* held in contact with the bottom plate 37 and positioned radially outwardly of the slanted surface 55*f*. The flat surface 55*g* has an outer peripheral edge positioned adjacent to an inner peripheral surface of the vertical wall 37*a* of the bottom plate 37.

The slanted surface 55*e* faces the center of the holder plate 55 and has a plurality of angularly spaced holes 57 for insertion therethrough of a plurality of sedimentation tube containers 60, respectively, the holes 57 being equidistant circumferentially. Each of the holes 57 has an upper edge which is positioned in the vicinity of a ridge of the slanted surfaces 55*e*, 55*f* and which is defined in the slanted surface 55*e*. The holes 57 are provided in an even number, which is four according to the illustrated embodiment as shown in FIG. 2. The slanted surface 55*f* has a lower face which is held in contact with an outer wall of the containers 60 as the latter are inserted through the holes 57, respectively. Thus, the lower face of the slanted surface 55*f* serves to hold the containers 60 against centrifugal forces tending to push the containers 60 radially outwardly during rotation of the rotor. The bottom plate 37 has a plurality of holes 37*c* which are angularly equally spaced in radial alignment with the holes 57 in the holder plate 55, respectively, for receiving the containers 60 therein. The holes 37*c* are of a diameter slightly larger than that of the containers 60. When the containers 60 are inserted through the holes 57 and 37*c*, they are kept inclined with respect to the bottom plate 37 and the holder plate 55 by radially inward edges of the holes 57, 37*c* and the inner surface of the slanted surface 55*f*.

A knob 59 includes a hollow cylindrical portion 59*a* which is fitted in the central hole 55*a* in the holder plate 55. The knob 59 and the holder plate 55 are securely coupled together by a snap ring 61 fitted in a peripheral slot in the cylindrical postion 59*a* and engaging the central flat portion 5*b* of the holder plate 55. The knob 59 has a cavity 59*c* that extends up to near an upper end of the knob 59 and receives therein the upper end portion of the attachment 36. A wall of the knob 59 which defines the cavity 59*c* has internal threads which are threadedly engageable with the external threads on the upper sidewall of the attachment 36. The holder plate 55 can be mounted securely on the bottom plate 37 simply by inserting the upper end portion of the attachment 36 into the cavity 59*c* and turning the knob 59 so as to be threaded over the attachment 36.

With the above arrangement, the bottom plate 37 and the holder plate 55 can be formed by pressing thin sheets of metal to desired contour. As a result, the rotor as a whole is of quite a small moment of inertia. The rotor can be accelerated up to a desired speed of rotation in the same time period as that for conventional rotors by an inexpensive motor for producing smaller driving forces. The rotor according to the illustrated embodiment is assembled of a small number of parts, can be fabricated with ease, and hence is relatively inexpensive to construct. Furthermore, the sedimentation tube containers 60 can easily be installed in place by being inserted through the holes 57 in the holder plate 55 and the alinged holes 37*c* in the bottom plate 37. No other procedure that requires special attention is needed for mounting the containers 60.

The bottom plate 37 and the holder plate 55 are fabricated of a sheet of metal which can be thinner than prior bottom and holder plates. Thus, the rotor of the present invention is of a smaller heat capacity. Although the rotor can easily be heated by friction with air on rotation, the rotor can also be cooled at a rapid rate with a smaller amount of stored heat, with the result that the net temperature of the rotor during operation thereof can be lowered.

The slanted surfaces 55*e*, 55*f* jointly constitute an annular bent portion which gives the holder plate 55 a mechanical strength sufficiently large to withstand centrifugal forces that the holder plate 55 undergoes while the rotor is in operation. The slanted surface 55*e* located radially inwardly of the annular bent portion provides an added reinforcement. Forces or stresses which would tend to deform the holder plate 55 are borne by the bottom plate 37 and the flat surfaces 55*a*, 55*g* which coact with each other against such deforming forces.

Figure 3:
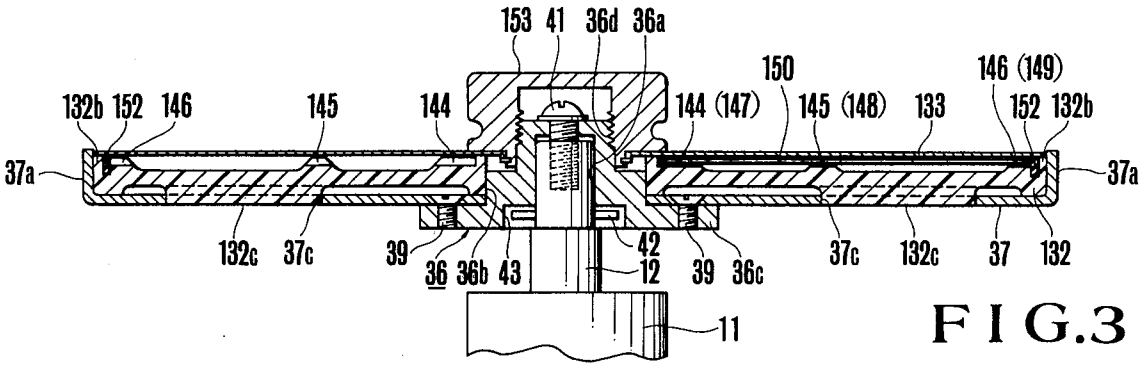
FIG. 3 is a cross-sectional view of a rotor for a centrifuge according to another embodiment of the present invention.
Figure 4:
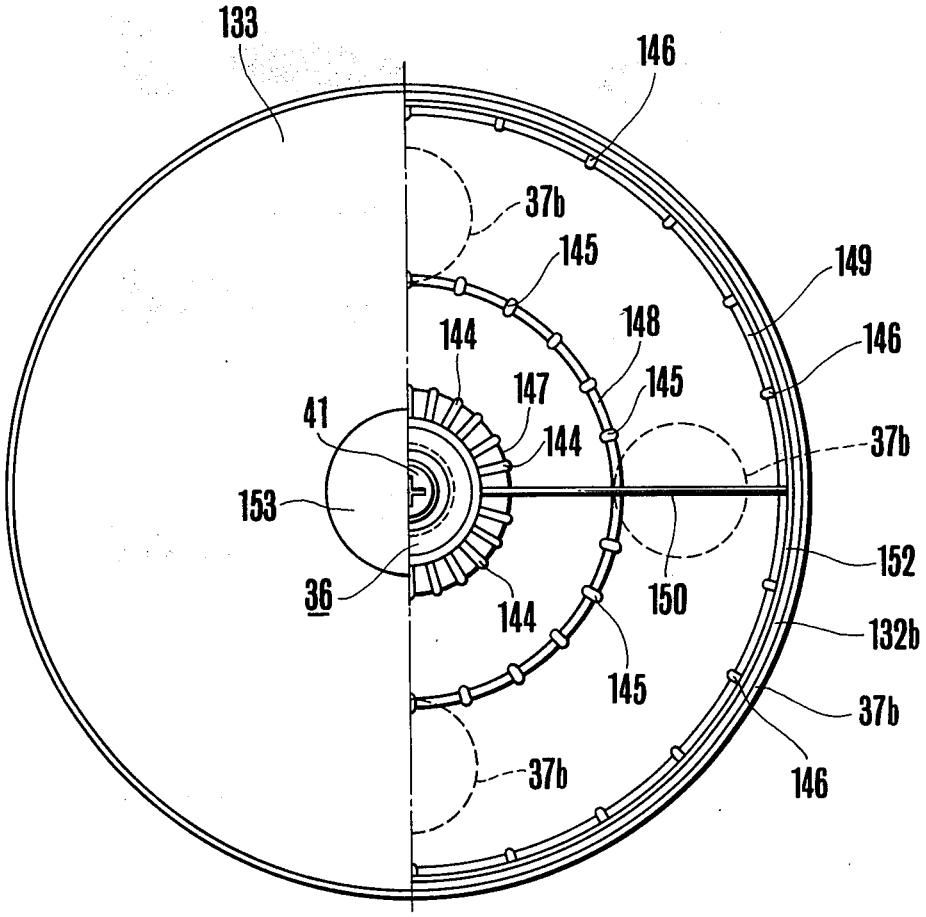
FIG. 4 is a plan view of the rotor illustrated in FIG. 3.

FIGS. 3 and 4 are illustrative of a centrifuge rotor according to another embodiment for holding capillary tubes. Like or corresponding parts shown in FIGS. 3 and 4 are denoted by like or coresponding reference characters shown in FIGS. 1 and 2. The rotor of FIGS. 3 and 4 includes an attachment 36 and a bottom plate 37 which are of the same construction as that of the attachment 36 and the bottom plate 37 illustrated in FIGS. 1 and 2. The rotor additionally includes a holder plate 132 disposed on the bottom plate 37 for holding capillary tubes, and a cover 133 which covers the holder plate 132. For converting the rotor of FIG. 1 into the rotor of Fig. 3, the holder plate 55 is first removed by rotating the knob 59 in a direction to disengage from the attachment 36, and then the holder plate 132 and the cover 133 are successively installed on the bottom plate 37.

The capillary tube holder plate 132 is made of a material such as plastics which is lightweight and can easily be shaped to contour. The holder plate 132 is circular in shape and has a central hole 132*a* in which the central shaft portion 36*b* of the attachment 36 is fitted. As shown in FIG. 4, the holder plate 132 has on its upper surface annular concentric ridges 147, 148, 149 which have slots 144, 145, 146, respectively, arranged in radially outward alignment. Capillary tubes 150 are fitted respectively in radially aligned sets of slots 144, 145, 146.

The holder plate 132 includes an annular tube retainer 132*b* extending along an outer circumferential edge thereof for retaining the capillary tubes 150 securely in the slots 144, 145, 146 against radially outward dislodgement. A protective cushioning ring 152 is disposed radially between the annular retainer 132 and the capillary tubes 150 for preventing the latter from being broken under centrifugal forces.

The holder plate 132 also has on its lower surface a plurality of circular lands or projections 132*c* fitted respectively in the circular holes 37*c* in the bottom plate 37 and having lower surfaces that lie flush with the lower surface of the bottom plate 37. The projections 132*c* as thus fitted in the holes 37*c* enables the holder plate 132 to rotate with the bottom plate 37 while the rotor is in operation. In addition, no air swirls could be produced by the projections 132*c* with their lower surfaces lying flush with the lower surface of the bottom plate 37. The rotor is therefore subjected to no undue resistance by air during rotation, and hence generates no unwanted noise.

The holder plate 132 is substantially fitted in the peripheral wall 37*a* of the bottom plate 37. The holder plate 132, which is molded of synthetic resin material as described above, has a small thermal conductivity that prevents heat generated by friction of the bottom plate 37 and the cover 133 with air from being conducted to the capillary tubes 150 which contain samples. For added heat insulation, the capillary tube 150 are supported only in the slots 144–146 in the ridges 147–149, and substantial areas of the sidewalls of the capillary tubes 150 are elevated above the upper surface of the holder plate 132 out of contact therewith.

The cover 133 is in the form of a flat circular plate, and includes a central knob 153 which allows the operator to pick up the cover 133. The central knob 153 has internal threads that are held in threaded engagement with the external threads on the central shaft portion of the attachment 36.

The holder plate 132 may be of other structures for supporting the capillary tubes 15 in a radial pattern than the illustrated construction including the annular ridges 147–149. The tube retainer 132*b* of the holder plate 132 may be dispensed with, and the protective ring 152 may be disposed on and along an inner peripheral surface of the peripheral wall 37*a* of the bottom plate 37.

The rotor for supporting capillary tubes as shown in FIGS. 3 and 4 are advantageous for the reasons which follow. The bottom plate 37 and the cover 133 can be shaped to desired contour as by pressing thin sheets of metal, and the holder plate 132 can be molded of easily moldable material such as plastics. The bottom plate 37 and the cover 133 may also be molded of plastics material. With the bottom plate 37, the holder plate 132, and the cover 133 being thus constructed, the resultant rotor has a small moment of inertia. An inexpensive motor of a small driving power requirement may be employed to rotate the rotor up to a desired speed within the same acceleration time as that for prior centrifuge rotors. Since the holder plate 132 is made of plastics which has small thermal conductivity, samples contained in the capillary tubes 150 supported on the holder plate 132 are subjected to a smaller temperature rise than that caused by conventional rotors.

The rotors according to the present invention have no wind shield plate and hence do not mislead the operator into erroneous setting of the rotors. If, for example, the operator tries by mistake to use the holder plate 55 as the cover 133 for making hematocrit determinations, the holder plate 55 is placed in a position elevated by the thickness of the holder plate 132, so that the knob 59 cannot be fastened to the attachment 36. For such a safety measure, the external threads 36*d* on the attachment 36 are positioned so that they fail to engage the internal threads in the knob 59 of the holder plate 55 when the latter is placed on the holder plate 132.

The rotor of the invention is divided into the bottom plate 37, the holder plate 132 for holding capillary tubes, and the holder plate 55 for holding sedimentation tubes, and is simple in construction for this reason. The bottom plate 37 is made of a small amount of aluminum alloy as it is in the form of a thin plate. The parts of the rotor can be mass-produced as by pressing. Therefore, the rotor is much less costly to manufacture from the standpoints of material and fabrication process. The holder plate 132, which is relatively complex in structure, is required to have a thermal insulation property and hence is molded of plastics material, a process which is capable of less costly mass production.

Although certain preferred embodiments have been shown and described in detail, it should be understood that many changes and modifications may be made therein without departing from the scope of the appended claims.

What is claimed is:

1. A rotor for a centrifuge, comprising a rotatable shaft, a disc-shaped bottom plate fixed to said rotatable shaft, and a holder plate mounted on said bottom plate for holding sedimentation tubes, said holder plate being integrally constructed of a thin plate and having a center, an outer edge, and a bent portion positioned between said center and outer edge and projecting upwardly between concentric flat portions in contact support with said bottom plate, said bent portion including a surface directed toward said center of the holder plate and having a plurality of holes for insertion therethrough of the sedimentation tubes, and said bottom plate having a plurality of holes aligned with said holes in said holder plate for receiving the sedimentation tubes therein including another holder plate for holding capillary tubes, said another holder plate being mountable on said bottom plate in place of said first mentioned holder plate, said bottom plate having an attachment including a shaft portion fitted in said another holder plate, said another plate having on an upper surface thereof a plurality of annular ridges having slots for receiving the capillary tubes in a radial pattern and wherein said another holder plate has a plurality of downward projections fitted respectively in said holes in said bottom plate.

2. A rotor according to claim 1, wherein said bottom plate has a vertical peripheral wall adjacent to said outer edge of said holder plate, includng a cover which covers a space surrounded by said vertical peripheral wall, said cover being removably attached to said shaft portion.

3. A rotor according to claim 2, wherein said cover includes a knob having a cavity in which said shaft is fitted.

4. A rotor according to claim 1, wherein said another holder plate is made of plastics.

5. A rotor according to claim 1, including a protective member disposed adjacent to the slots in the annular ridge which is located radially outwardly of the other annular ridges and extending along said outer edge of said holder plate for protecting the capillary tubes against damage.

6. A rotor for a centrifuge, comprising a dish-shaped bottom plate having a plurality of holes and connectable to a rotatable drive shaft of the centrifuge, a holder plate removably mountable on said bottom plate and having a plurality of holders for supporting thereon a plurality of capillarly tubes radially of the rotatable drive shaft, said holder plate having a plurality of projections fittable respectively in said holes in said bottom plate, a cover detachably attachable to said bottom plate for covering said holder plate mounted on said bottom plate, and another holder plate removably mountable on said bottom plate and having an annular projection of a triangular cross section extending concentrically with said rotatable drive shaft, said annular projection having in its slanted, radially inwardly facing portion a plurality of holes held in radial alignment with said holes in said bottom plate for receiving therein a plurality of sedimentation tubes, respectively.

* * * * *